US006279275B1

(12) United States Patent
Sawyer

(10) Patent No.: US 6,279,275 B1
(45) Date of Patent: Aug. 28, 2001

(54) FOUNDATION WALL CONSTRUCTION HAVING WATER IMPERVIOUS DRAIN PANELS

(76) Inventor: Robert D. Sawyer, 6365 S. 20th St., Oak Creek, WI (US) 53154

( * ) Notice: Subject to any disclaimer, the term of this patent is extended or adjusted under 35 U.S.C. 154(b) by 0 days.

(21) Appl. No.: 09/593,185

(22) Filed: Jun. 14, 2000

(51) Int. Cl.[7] ..... E02D 19/00

(52) U.S. Cl. ..... 52/169.5; 52/169.14; 52/741.3; 405/43

(58) Field of Search ..... 52/169.5, 169.14, 52/741.4, 741.3; 405/43, 47

(56) References Cited

U.S. PATENT DOCUMENTS

| | | | | |
|---|---|---|---|---|
| 4,943,185 | * | 7/1990 | McGuckin et al. | 405/45 |
| 5,534,303 | | 7/1996 | Roberts et al. . | |
| 5,692,348 | * | 12/1997 | Ambrosino | 52/169.5 |
| 5,857,297 | | 1/1999 | Sawyer . | |
| 5,899,031 | * | 5/1999 | Nagaoka et al. | 52/169.5 |
| 5,930,960 | * | 8/1999 | Konnerth | 52/169.5 |

* cited by examiner

*Primary Examiner*—Christopher T. Kent
*Assistant Examiner*—Jennifer I. Thissell
(74) *Attorney, Agent, or Firm*—Andrus, Sceales, Starke & Sawall

(57) ABSTRACT

A water impervious panel assembly for a foundation wall. A series of rigid, extruded thermoplastic panels are mounted in side-by-side relation to the outer surface of the foundation wall. Each panel has inner and outer faces connected together by a series of parallel spaced ribs which define vertical flow channels that extend the height of the panel. A plurality of holes are formed in the outer face of each panel and communicate with the channels. The holes and channels facilitate movement of water to the drain tile at the footing of the wall and relieve hydrostatic pressure on the wall. To provide a watertight vertical joint between adjacent panels, the inner face of each panel adjacent one vertical side edge is provided with a first vertical slot that communicates with the flow channel located adjacent that side edge and the outer face of each panel adjacent the opposite side edge is provided with a second vertical slot that communicates with a flow channel adjacent that side edge. A first vertical rib located outwardly of the first slot of one panel is received within a second slot adjacent the second side edge of an adjacent panel to provide an interlocking watertight joint between the panels.

15 Claims, 2 Drawing Sheets

FOUNDATION WALL CONSTRUCTION HAVING WATER IMPERVIOUS DRAIN PANELS

BACKGROUND OF THE INVENTION

Waterproofing coatings are frequently applied to the outer surface of concrete foundation walls to prevent water penetration through the wall. An extremely effective waterproofing coating is that described in U.S. Pat. No. 5,352,531. The coating of that patent is a highly adhesive, elastomeric type which is asphalt free and is non-hazardous and non-toxic when cured. The coating when applied to a foundation wall provides an adhesive, water impervious membrane that prevents penetration of water through the wall, even when the wall is subjected to substantial hydrostatic pressure.

To prevent damage to the elastomeric coating when the wall is back-filled through the use of mechanical handling equipment, it has been the practice to apply protection board over the elastomeric coating. A common type of protection board, as used in the past, is polystyrene foam board. The polystyrene board aids in protecting the elastomeric coating and has some insulating value. However, the polystyrene foam can be fractured by back-filling and is not waterproof. Over time the polystyrene foam will absorb water, and in itself does not constitute a waterproofing membrane.

U.S. Pat. No. 5,857,297 describes an improved waterproofing system for a backfilled foundation wall, in which an extruded, rigid, thermoplastic protection board is applied over the elastomeric coating on the foundation wall. The protection board, as described in U.S. Pat. No. 5,857,297, includes an inner face which is bonded to the elastomeric coating and a parallel outer face. A plurality of spaced ribs interconnect the two faces and define a plurality of vertical flow channels which extend the entire height of the board. A series of openings, slots or holes are formed in the outer face of the board and communicate with the flow channels. Water from the soil can enter the openings and flow downwardly through the flow channels to the drain tile, thus draining the water as well as relieving hydraulic pressure against the wall.

With the waterproofing system as described in U.S. Pat. No. 5,857,297, the elastomeric coating applied to the foundation wall is extremely tacky or adhesive and if the protection boards are not properly aligned in side-by-side relation, it is very difficult to remove or shift the boards. When this happens, it is necessary to seal the joints between adjacent vertical edges of the boards by caulking or sealing tape, or re-cut new boards for proper alignment. This manual joint sealing or re-cutting operation requires considerable time and labor.

SUMMARY OF THE INVENTION

The invention is directed to an improved water impervious panel assembly for a foundation wall, and in particular to a novel waterproof joint construction between side edges of adjacent panels that eliminates manual sealing of the joints. The panels are preferably formed of extruded thermoplastic material and are secured in side-by-side relation to the outer surface of the foundation wall. Each panel includes an inner face which bears against the foundation wall and a parallel outer face. A series of spaced ribs interconnect the two faces and define a plurality of vertical flow channels which extend the entire height of the panel. Drain holes are formed in the outer face of each panel and provide communication with the flow channels. With this construction ground water will flow through the drain holes into the channels and then downwardly through the channels to the drain tile. To provide a waterproof joint between side edges of adjacent panels, the inner face of each panel adjacent one vertical side edge is provided with a vertical slot that communicates with a flow channel located adjacent that side edge. Similarly, the outer face of each panel adjacent the opposite vertical side edge is provided with a second vertical slot that communicates with a flow channel located adjacent the second side edge. Both slots extend the entire height of the panel.

With this construction, a rib bordering the first side edge of one panel is received within a slot adjacent the second side edge of an adjacent panel to provide an interlocking joint between the side edges of adjacent panels that is waterproof and requires no auxiliary sealing materials.

As the construction of the invention provides a positive mechanical interlock, as well as a seal between the adjacent side edges of the panels, proper side-by-side alignment of the panels is assured.

The waterproofing system of the invention does not require the use of a continuous elastomeric or asphalt coating on the foundation wall, as used in the past. By eliminating the use of the elastomeric or asphalt coating, the invention also eliminates the need for a solvent spray system which is used to apply such coating.

Other objects and advantages will appear in the course of the following description.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
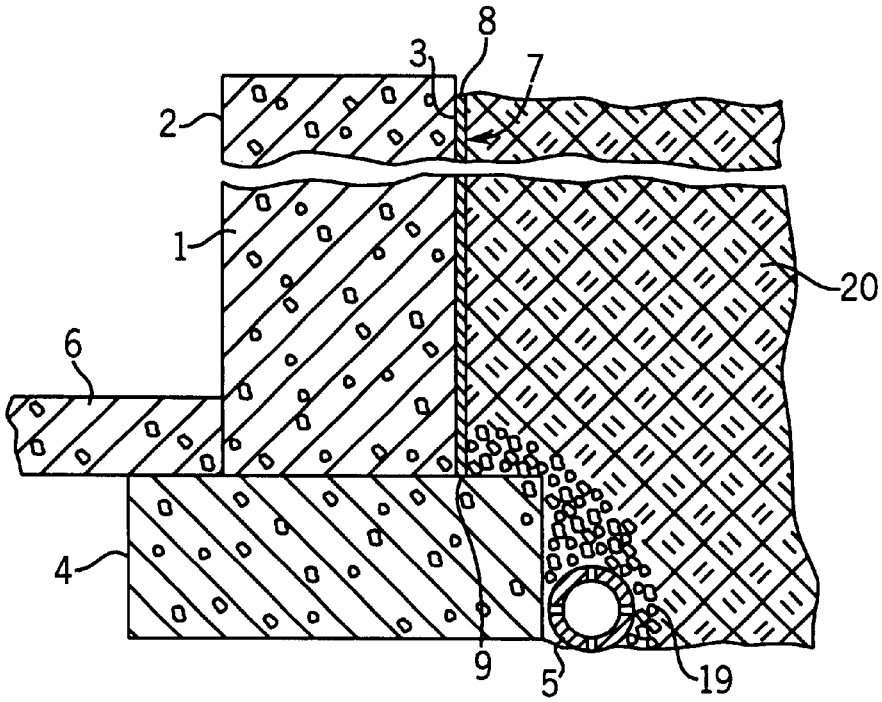
FIG. 1 is a vertical section of the waterproof wall construction of the invention.

As shown in FIG. 1, the wall construction includes a vertical foundation wall 1 which can be composed of cast-in-place concrete, concrete block or expanded polymeric blocks filled with concrete. Wall 1 includes an inner surface 2 which faces inwardly of the building and an outer surface 3.

The lower end of foundation wall 1 rests on the central portion of a concrete footing 4 and a drain tile 5 is located outwardly of footing 4. The concrete floor 6 of the building rests on the upper inner surface of footing 4.

A series of panels 7 are mounted in side-by-side relation on outer surface 3 of wall 1. Sheets or panels 7 are preferably formed of an extruded thermoplastic resin, such as polypropylene or polyethylene copolymers, and can be constructed as described in U.S. Pat. No. 5,857,297.

Figure 3:
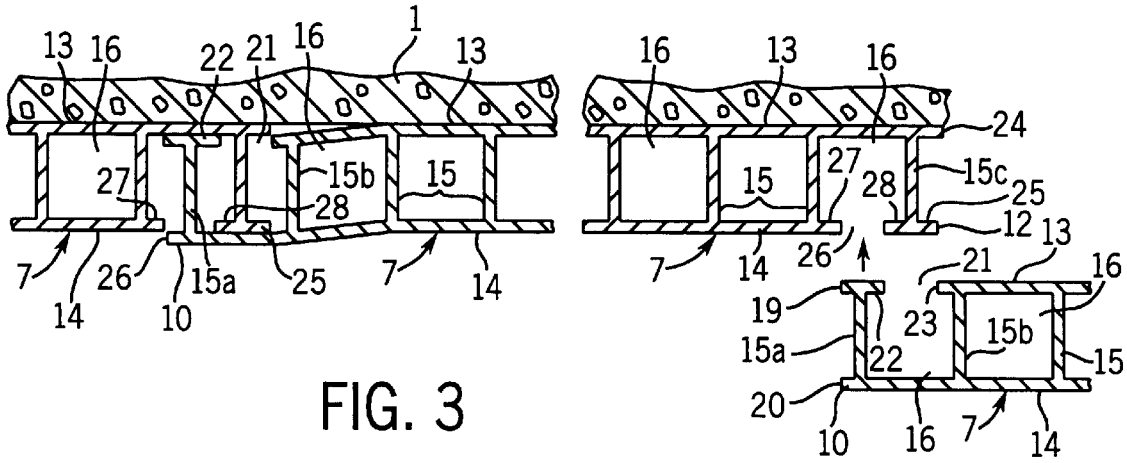
FIG. 3 is a horizontal section of the wall construction.

Each panel 7 includes an upper horizontal edge 8, a lower edge 9, which rests on footing 4 and a pair of vertical side edges 10 and 12. As best seen in FIG. 3, each panel consists of an inner face 13 and a parallel outer face 14 which are joined together by a plurality of spaced vertical ribs 15 which define a series of parallel flow channels 16. Panels 7 can be attached to outer surface 3 of wall 1 in any convenient manner, such as, for example, through use of a continuous elastomeric coating, as described in U.S. Pat. No. 5,857,297, or through use of spaced beads of an adhesive, or through the use of nails, or other mechanical fasteners.

The upper ends of flow channels 16 can be closed off, if desired, by use of a sealing material 17, such as caulking, tape or an extruded thermoplastic cap or cover, to prevent debris or foreign material from entering and possibly clogging the flow channels. The lower ends of the flow channels are open and are located adjacent footing 4.

Figure 2:
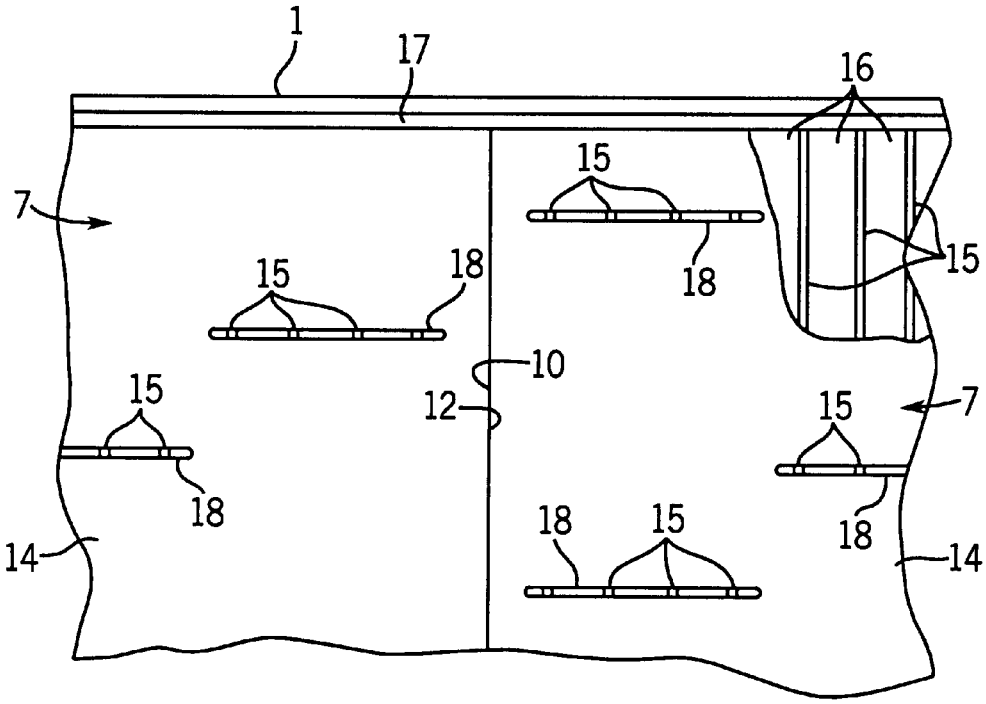
FIG. 2 is a fragmentary plan view of a pair of panels mounted on a foundation wall with parts broken away in section.

As best shown in FIG. 2, the outer face 14 of each panel is formed with a plurality of spaced openings or slots 18, which provide communication between a group of flow channels 16 and the exterior. In a preferred form of the invention, the slots 18 are formed by a circular saw which cuts away a portion of the outer face 14 to expose the flow channels, yet maintains the integrity of the channels. The particular pattern of the slots or holes is not critical and holes or openings of various configurations can be formed in outer face 14 to expose the flow channels 16.

After the panels 7 have been attached to wall 1, gravel back-fill 19 is applied over drain tile 5 and the wall is then back-filled with soil, as indicated by 20, with the established grade of the backfill being slightly above the upper edge 8 of the panels 7.

In accordance with the invention, a novel system is provided for creating a mechanical interlock, as well as a sealed joint between side edges 10,12 of adjacent panels 7. As best seen in FIG. 3, inner face 13 and outer face 14 project laterally beyond the outermost rib 15*a* at side edge 10 of the panel, as shown by the projecting edges 19 and 20 respectively. A slot 21 is formed in inner face 13 adjacent side edge 10 and extends the entire height of panel 7. As shown in FIG. 3, slot 21 has a lesser width than the width of flow channel 16, so that edges 22 and 23 extend laterally from ribs 15*a* and 15*b* and border slot 21. Vertical edge 12 has a similar construction. Inner face 13 and outer face 14 project laterally beyond rib 15*c* at side edge 12, as shown by the projecting edges 24 and 25. Slot 26 is formed in outer face 14 adjacent side edge 12 and extends the full height of the panel and communicates with flow channel 16 located adjacent side edge 12. Slot 26 has a lesser width than flow channel 16, so that edges 27 and 28 of outer face 14 extend laterally and border slot 26.

To assemble panels 7, a first panel is secured to outer surface 3 of wall 1 by adhesives or mechanical fasteners and rib 15*a* of a second panel is then inserted into slot 26 of the first panel, as shown in FIG. 3. The projecting edges 19 and 22 of the second panel define a generally flat surface which seats against the inner surface of inner face 13, while rib 15*c* of the first panel is received within slot 21 of the second panel. Edges 25 and 28 define a flat surface which seats against the inner surface of outer face 14.

When inserting the ribs 15*a* into slots 26, and rib 15*c* into slot 21, the ribs 15*a* and 15*c* can flex outwardly and will then snap back into position to provide a mechanical interlock between the panels. Further, the engagement of the flat surface 19,22 with the inner surface of interface 13 and the engagement of the flat surface 25,27 with the inner surface of outer face 14 provides a tortuous and sealed path for any flow of water through the interlocked panels, thus providing a watertight joint which is created without the use of auxiliary sealants or tape and without the requirement for special tools or equipment. Further, the interlocking nature of the side edges of the panels assures that the panels will be properly aligned together.

As previously noted, panels 7 can be attached to foundation wall through adhesives or through mechanical fasteners and it is not necessary to employ a continuous waterproof elastomeric coating to the foundation wall, for the panels themselves provide the waterproofing system.

Figure 4:
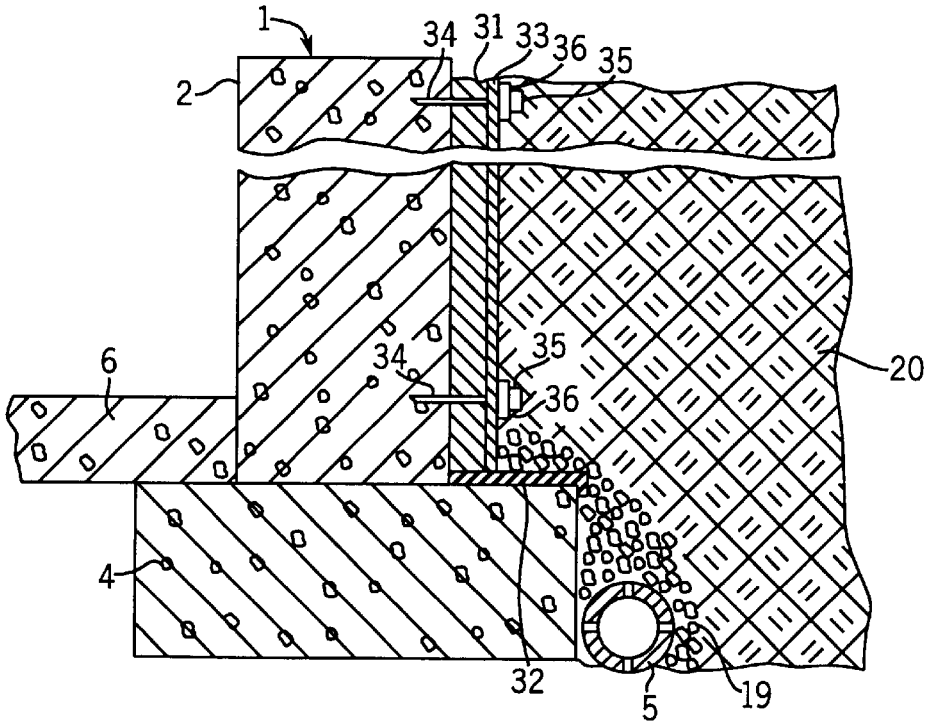
FIG. 4 is a vertical section of a modified form of the wall construction of the invention.

FIG. 4 illustrates a modified form of the invention in which added insulation is incorporated with the panels. In this embodiment, insulation board 31 is disposed against the outer surface 3 of foundation wall 1. The insulation board 31 can be a rigid polymeric foam material, such as polystyrene foam, and is used in the form of large sheets, generally one or two inches thick, that preferably extend the full height of the wall. A coating 32 of a waterproofing material, such as an elastomeric polymer as described in U.S. Pat. No. 5,857,297, can be applied across the lower portion of foundation wall 1 and on the upper surface of footing 4. The lower edges of insulation boards 31 rest on the coating 32, as shown in FIG. 4.

Panels 33, similar in construction to panels 7 of the first embodiment, are secured to the outer surface of insulation boards 31 by a series of nails 34. Nails 34 penetrate the panels 33, as well as insulation board 31 and are embedded in the foundation wall 1. Heads 35 of nails 34 bear against washers 36 that are in contact with the outer surface of panels 33. Nails 34 can be applied to the foundation wall using a conventional power operated nailing gun. Alternately, the insulation board 31, as well as panels 33 can be secured to foundation wall 12 through adhesives.

The vertical edges of panels 33 can be interlocked and sealed in the manner as previously described with respect to panels 7, so that the panels 33 provide a waterproof membrane or barrier which prevents water from contacting insulation board 31, as well as foundation wall 1. The interlocked vertical joint itself constitutes a channel or conduit for directing water to the drain tile below. With this construction, water in the soil will pass through holes in the outer face of panels 33 into the vertical flow channels and the water will then flow downwardly into the drain tile 5, as previously described.

With the construction shown in FIG. 4, the panels 33 not only protect the insulation board 31 against damage during back-filling, but also prevent water from being absorbed into the polymeric foam insulation board which adversely affects the insulating value of the polymeric foam.

Various alternatives and embodiments are contemplated as being within the scope of the following claims particularly pointing out and distinctly claiming the subject matter regarded as the invention.

I claim:

1. A water impervious panel assembly for a foundation wall, comprising a first panel and a second panel, each panel having a first face and a second face disposed parallel to said first face, each panel also including a plurality of spaced parallel ribs connecting the faces together and defining a plurality of parallel flow channels, each panel having a first side edge and a second side edge, said ribs being parallel to said side edges, the first face of each panel having a first slot adjacent and parallel to said first edge and communicating with a first flow channel disposed adjacent said first edge, said first slot extending the entire height of said panel, the second face of each panel having a second slot disposed adjacent and parallel to said second edge, said second slot communicating with a second flow channel adjacent said second edge, said second slot extending the entire height of said panel, a first rib of the first panel bordering said first edge being disposed in the second slot of said second panel to provide a sealed joint between the first edge of the first panel and the second edge of the second panel, and a plurality of spaced openings in said second face of each panel and communicating with the flow channels.

2. The assembly of claim 1, wherein the width of the first slot is less than the width of the first flow channel and the width of the second slot is less than the width of the second flow channel.

3. The assembly of claim 2, wherein the first face and the second face project laterally outward beyond said first rib and a portion of the first face projects laterally inward beyond said first rib and borders said first slot.

4. The assembly of claim 2, wherein the first face and said second face project laterally outward beyond said second rib and a portion of said second face projects laterally inward beyond said second rib and borders said second slot.

5. The assembly of claim 2, wherein a portion of the first face of the first panel connected to the first rib is relatively flat and bears against the inner surface of the first face of the second panel and a portion of the second face of the second panel connected to the second rib is relatively flat and bears against the inner surface of the second face of the first panel.

6. A foundation construction, comprising a foundation wall having an inner surface and an outer surface, a plurality of panels disposed in side-by-side relation against the outer surface of said foundation wall and composed of rigid plastic material, and securing means for securing the panels to the outer surface of said foundation wall, each panel having an inner face disposed adjacent the outer surface of the foundation wall and having a parallel outer face, each panel also having a plurality of spaced parallel ribs connecting the faces together and defining a plurality of generally vertical flow channels, each panel having a first vertical side edge and a second vertical side edge and having a top edge and a bottom edge, said ribs being generally parallel to said side edges, the inner face of each panel having a first slot adjacent and parallel to said first side edge and communicating with a first flow channel adjacent said first side edge, said first slot extending the entire height of the panel, the second face of each panel having a second slot adjacent and parallel to said second side edge and communicating with a second flow channel adjacent said second side edge, said second slot extending the entire height of the panel, a first rib of a first panel bordering said first side edge being disposed in the second slot of a second panel to provide a sealed joint between the first side edge of said first panel and the second side edge of the second panel, and a plurality of openings in said second face of each panel communicating with said flow channels.

7. The foundation construction of claim 6, wherein the width of the first slot is less than the width of the first flow channel and the width of the second slot is less than the width of the second flow channel.

8. The foundation construction of claim 6, wherein said first face and said second face project laterally outward beyond the respective first and second ribs and a portion of the first face projects laterally inward beyond said first rib and borders the first slot and a portion of the second face projects laterally inward beyond the second rib and borders said second slot.

9. The foundation construction of claim 8, wherein the portion of the first face of the first panel connected to the first rib bears against the inner surface of the first face of the second panel.

10. The foundation construction of claim 6, and including a layer of insulating material disposed between the outer surface of the foundation wall and the inner face of each panel.

11. The foundation construction of claim 10, wherein said insulating material comprises a polymeric foam material.

12. The foundation construction of claim 6, wherein said securing means comprises a plurality of nails extending through said panels and said insulating material and secured to said foundation wall.

13. The foundation construction of claim 6, wherein said securing means comprises a layer of elastomeric material.

14. The foundation construction of claim 6, and including a footing to support said foundation wall, the lower edges of said panels being supported on said footing.

15. The foundation construction of claim 6, wherein said openings comprise a series of spaced generally horizontal slots in said outer face, each slot communicating with a plurality of adjacent flow channels.

* * * * *